US005642018A

United States Patent [19]

Marcotte

[11] Patent Number: 5,642,018

[45] Date of Patent: Jun. 24, 1997

[54] DISPLAY PANEL SUSTAIN CIRCUIT ENABLING PRECISE CONTROL OF ENERGY RECOVERY

[75] Inventor: Robert G. Marcotte, New Paltz, N.Y.

[73] Assignee: Plasmaco, Inc., Highland, N.Y.

[21] Appl. No.: 563,947

[22] Filed: Nov. 29, 1995

[51] Int. Cl.[6] ..... G09G 3/10

[52] U.S. Cl. ..... 315/169.4; 315/169.3; 315/169.1; 315/209 R; 315/314; 315/360

[58] Field of Search ..... 315/169.4, 169.3, 315/169.1, 209 R, 168, 244, 276, 314, 360; 327/108, 111, 112, 380, 381, 392, 393; 340/643, 593

[56] References Cited

U.S. PATENT DOCUMENTS

| | | | |
|---|---|---|---|
| 4,316,123 | 2/1982 | Kleen et al. | 315/169.4 |
| 4,347,509 | 8/1982 | Hardway et al. | 340/778 |
| 4,496,879 | 1/1985 | Suste | 315/169.4 |
| 4,772,884 | 9/1988 | Weber et al. | 340/776 |
| 4,866,349 | 9/1989 | Weber et al. | 315/169.4 |
| 4,924,218 | 5/1990 | Weber et al. | 340/776 |
| 5,081,400 | 1/1992 | Weber et al. | 315/169.4 |
| 5,438,290 | 8/1995 | Tanaka | 327/108 |
| 5,446,344 | 8/1995 | Kanazawa | 315/169.4 |

*Primary Examiner*—Robert Pascal
*Assistant Examiner*—Haissa Philogene
*Attorney, Agent, or Firm*—Ohlandt, Greeley, Ruggiero & Perle

[57] ABSTRACT

An energy efficient driver circuit for driving a display panel having panel electrodes and panel capacitance includes an inductor means coupled to the panel electrodes; a driving voltage source; a voltage supply for providing a supply voltage of a magnitude which is greater than the driving voltage; a first switch device for selectively coupling the driving voltage to the inductor in response to a rising input signal transition, the input signal transition commencing a first state wherein a first current flow occurs through the inductor to charge the panel capacitance, the inductor causing the panel electrodes to rise to a voltage in excess of the driving voltage, at which point the first current flow reaches zero; and a second switch device for selectively coupling the voltage supply to the inductor and panel electrodes. A switch control is responsive to current flow in the inductor and is operative during the first state to initially maintain the second switch device in an open condition, and thereafter, in response to signals derived from the inductor, to cause a closure of the second switch device at a time which enables said second switch device to be fully conductive when the first current flow reaches zero, whereby the supply voltage source during a succeeding second state supplies current to both the panel electrodes and flyback current to said inductor. A like circuit is similarly operational on a falling input signal transition.

10 Claims, 9 Drawing Sheets

DISPLAY PANEL SUSTAIN CIRCUIT ENABLING PRECISE CONTROL OF ENERGY RECOVERY

FIELD OF THE INVENTION

This invention is related to sustain signal driver circuits for a capacitive display panel and, more particularly, to a sustain signal driver circuit which enables precisely controllable energy recovery and prevents inductively created flyback currents from adversely affecting pixel sites in the panel.

BACKGROUND OF THE INVENTION

Plasma display panels, or gas discharge panels, are well known in the art and, in general, comprise a structure including a pair of substrates respectively supporting column and row electrodes, each coated with a dielectric layer disposed in parallel spaced relation to define a gap therebetween in which an ionized gas is sealed. The substrates are arranged such that the electrodes are disposed in orthogonal relation to one another, thereby defining points of intersection which, in turn, define discharge pixel sites at which selective discharges may be established to provide a desired storage or display function. It is also known to operate such panels with AC voltages and particularly to provide a write voltage which exceeds the firing voltage at a given discharge site, as defined by selected column and row electrodes, thereby to produce a discharge at a selected cell. The discharge at a selected cell can be continuously "sustained" by applying an alternating sustain voltage (which, by itself, is insufficient to initiate a discharge). This technique relies upon wall charges generated on the dielectric layers of the substrates which, in conjunction with the sustain voltage, operate to maintain continuing discharges.

Details of the structure and operation of gas discharge panels or plasma displays are set forth in U.S. Pat. No. 3,559,190 issued Jan. 26, 1971 to Donald Bitzer, et al. and in U.S. Pat. No. 4,772,884 to Weber et al. issued Sep. 20, 1988.

Energy recovery sustainers have been developed for plasma display panels to enable recovery of energy used to charge and discharge the panel's capacitance. As AC plasma display panels have grown in size and operating voltage, the need to precisely control the turn-on of sustain signal drivers has become critical. Turning on sustain signal drivers too early results in lower efficiency and larger electromagnetic (EMI) emissions. Late turn-on results in premature gas discharges within the panel which adversely affects operating margins.

Because a sustain pulse's rise time is controlled by a resonant circuit comprising the sustainer's inductor and the display panel's capacitance, the rise time can vary considerably, based upon the number of ON and OFF pixel sites (i.e., the data content stored in the panel can cause a wide variation in the panel's capacitance). In sustain drivers which employ fixed timing circuits, this variability must be minimized by adding ballast capacitance, which increases power dissipation, or by adding complex capacitance compensation circuits.

The variable capacitance problem can only be solved by use of a variable timing circuit which is capable of turning on sustain driver circuits as the inductor concludes its resonant cycle. Prior art circuits have waited to turn on the sustain driver until the inductor's current goes to zero and reverses direction. This creates a "flyback" transition on the energy recovery side of the inductor which is used to trigger the turn-on of output drivers. With today's voltages and gas mixtures, the flyback occurs too late to be fully useful. The output driver must begin to turn on as the inductor current diminishes and well before a flyback current occurs.

Use of flyback current to control sustain output drivers has an unwanted side effect of drawing current out of the panel, while the output driver is turning on. This creates ringing currents throughout the system. The voltage flyback occurs on the recovery side of the inductor at the completion of the resonant cycle. The inductor voltage is opposite to that of the original applied forcing voltage. Flyback current flows to charge or discharge the capacitance on the recovery side of the inductor to match the panel voltage. In doing so, charge is transferred that is opposite to the desired transition, resulting in an increase in non-recoverable energy consumed by the circuit and a noisy transition as the output driver turns on.

Weber et al., in U.S. Pat. Nos. 4,866,349 and 5,081,400, disclose a power efficient sustain driver for an AC plasma panel. While, the disclosure of the Weber et al. patent is incorporated herein by reference, because the invention disclosed herein is a direct improvement of the Weber et al. design, details of that design will be hereafter described. The Weber et al. sustain driver circuit employs inductors in the charging and discharging of panel capacitances so as to recover a large percentage of energy theretofore lost in driving panel capacitances. FIGS. 1–4 hereof are directly taken from the Weber et al. patent.

FIG. 1 shows an idealized schematic of the Weber et al. sustain driver and FIG. 2 shows the output voltage and inductor current waveforms expected for the circuit of FIG. 1, as four switches S1, S2, S3, S4 are opened and closed through four successive switching states. It is to be understood that each idealized circuit shown hereafter is driven by a logic level control signal which has both a leading rising edge and a lagging falling edge. The means for connecting the source of the control signals to the driver circuit are only shown on the detailed circuit views.

It is assumed, prior to State 1, that recovery voltage Vss is at Vcc/2 (where Vcc is the sustain driver's power supply voltage), Vp is at zero, S1 and S3 are open, and S2 and S4 are closed. Capacitance Css must be much greater than Cp to minimize variation of Vss during States 1 and 3. The reason that Vss is at Vcc/2 will be explained, below, after the switching operation is explained.

State 1: At the leading, rising edge of an input sustain pulse, S1 closes, S2 opens, and S4 opens (S3 is open). With S1 closed, inductor L and Cp (which is the panel capacitance as seen from the sustain driver circuit) form a series resonant circuit, and a "forcing" voltage of Vss=Vcc/2 is applied thereto. Vp rises to Vcc (through action of inductor L), at which point $I_L$ has fallen to zero, and diode D1 becomes reverse biased.

State 2: S3 is closed to clamp Vp at Vcc and to provide a current path for any "ON" pixels in the panel. When a pixel is in the ON state, its periodic discharges provide a substantial short circuit across the ionized gas, with the current required to maintain the discharge supplied from Vcc. The discharge/conduction state of a pixel is represented by icon 10 in FIG. 1.

State 3: (occurs upon the falling lagging edge of the input sustain pulse); S2 closes, S1 opens, and S3 opens. With S2 closed, inductor L and capacitance Cp again form a series resonant circuit, with the voltage across inductor L equal to Vss=Vcc/2. However the polarity of the voltage is reverse to that in State 1, causing a negative flow of current $I_L$. Vp then falls to ground as the stored energy in inductor L is dissipated, at which point $I_L$ has reached zero. D2 becomes reverse biased.

State 4: S4 is closed to clamp Vp at ground while an identical driver on the opposite side of the plasma panel drives the opposite side to Vcc and a discharge current then flows in S4 if any pixels are "ON".

It was assumed above that Vss remains stable at Vcc/2 during charging and discharging of Cp. The reasons for this are as follows. If Vss were less than Vcc/2, then on the rise of Vp, when S1 is closed, the forcing voltage would be less than Vcc/2. Subsequently, on the fall of Vp, when S2 is closed, the forcing voltage would be greater than Vcc/2. Therefore, on average, current would flow into Css. Conversely, if Vss were greater than Vcc/2, then on average, current would flow out of Css. Thus, the stable voltage at which the net current into Css is zero, is Vcc/2. In fact, on power up, as Vcc rises, if the driver is continuously switched through the four states explained above, then Vss will rise with Vcc to Vcc/2.

The circuit implementation of the idealized circuit of FIG. 1 is shown in FIG. 3 and the associated timing diagram is shown in FIG. 4. Transistors T1–T4 replace switches S1–S4, respectively. Driver 1 is used to control transistors T1 and T2 in a complementary fashion so that when T1 is on, T2 is off and vice-versa. Driver 2 uses the time constant of R1-C3 or the voltage rise at V1 to turn on transistor T4. Similarly, Driver 3 uses the time constant of R2-C4 or the voltage rise of V2 to turn on transistor T3. Diodes D3 and D4 are used to turn off transistors T3 and T4 quickly.

State 1: To start, T4 and T2 turn off, and T3 is off, waiting to be turned on by the R2-C4 time constant or the rise of V2 (all via diode DC2). An input sustain pulse transition from source 12 turns T1 on and Vss is applied to nodes V1, A, and V2. Inductor L and panel capacitance Cp form a series resonant circuit, which has a forcing voltage of Vss=Vcc/2. As a result of the stored energy in inductor L, Vp rises past Vss to Vcc, at which point $I_L$ goes to zero.

Since Vp typically rises to 80% of Vcc, inductor L thereafter sees a forcing voltage (from the panel side) of Vp minus Vss. Negative current $I_L$ now flows out of the panel, back through the inductor L, reverse biases D1 and charges the capacitance of T2. This is the current flyback previously mentioned and starts at time t1 in FIG. 4. The flyback current causes voltage flyback at A and V2 to rise sharply. As V2 rises, C4 couples this rise to trigger Driver 3 to turn on T3.

The panel voltage Vp drops as energy is taken out of the panel by the flyback current and put back into inductor L between times t1 and t2. This flyback energy is dissipated in T3, L, D2, and DC2.

State 2: T3 is turned on to clamp Vp at Vcc and to provide a current path for any discharging "ON" pixel. Since energy was put into inductor L, negative current $I_L$ continues to flow from T3, and through inductor L, diode D2, and diode DC2, until the energy is dissipated. All of the aforesaid components are low loss components so the current decay is slow.

State 3: T1 and T3 turn off, T4 remains off, and T2 turns on. Vp is approximately Vcc, as the panel capacitance Cp is fully charged. With T2 on, inductor L and panel capacitance Cp again form a series resonant circuit, having a forcing voltage across inductor L of Vss=Vcc/2. Vp then falls to ground, at which point $I_L$ is zero. Similar to the end of State 1, the forcing voltage due to the stored energy in inductor L is of reverse polarity, and D2 becomes reverse biased and discharges the capacitance of T1, pulling node V1 to ground, sharply. The flyback current $I_L$ occurs at time t3 and is coupled through C3 to Driver 2 which turns on T4.

State 4: T4 clamps Vp at ground while an identical driver on the opposite side of the panel drives the opposite side to Vcc and a discharge current then flows in T4 if any pixels are "ON".

The above design has a number of deficiencies:

1) At time t1, where Vp peaks before T3 turns on, gas discharge activity can begin. Since Vp is less than Vcc, any discharges will be weaker than desired, resulting in dim areas or flickering pixel sites. The discharge has an added affect of further pulling Vp down before T3 can turn on, thus reducing efficiency.

2) As operating voltages and panel capacitance increase, it becomes necessary to use large area mosfets due to the high currents required. The larger mosfets and higher voltages produce much greater flyback energy levels which must be dissipated during State 2. This is the leading cause for the output voltage drop between times t1 and t2. Since all components are designed for low losses, the inductor current flowing during State 2 continues to flow into State 3 and disturbs the sustainer's falling transition.

3) Stray inductance in the panel and interconnect wiring add considerable noise to the system during the turn-on of T3 and T4. Since the flyback action draws current from the panel and T3 sources current to pull up the output, the result is a large, fast current change in the panel which affects the entire ground system of the display, creating radiated Electromagnetic Interference (EMI).

4) Because R1 and R2 will turn on the output transistors, regardless of the resonant cycle, the circuit is capable of dissipating considerable power during fault conditions.

SUMMARY OF THE INVENTION

The invention described herein builds upon the Weber et al. design by adding a secondary winding to the inductor to enable a control network to enable early turn on of either the high side driver or the low side driver. The winding produces a voltage proportional to the instantaneous voltage across inductor L. As the current flows through inductor L into panel capacitance Cp, the voltage across inductor L diminishes to zero when the panel voltage equals the recovery voltage (one half the sustain voltage). The energy stored in inductor L keeps current flowing to further charge the panel capacitance Cp. As the panel voltage rises above the recovery voltage, the polarity of the inductor voltage reverses and increases with the panel voltage. This polarity change and voltage rise is followed by the secondary winding and is used to turn on the respective output driver. The output driver's turn-on is dampened by a gate resistor. This allows the mosfet's capacitance to restrict the current flow through the mosfet, allowing inductor L to transfer it's remaining energy into the panel.

Since the polarity change must occur before the output driver can turn on, the amount of energy transferred by the inductor is always maximized even under varying capacitive loads. EMI effects are reduced because the output driver is allowed to turn on slowly and is fully on when the flyback occurs. This eliminates the ringing currents present on the earlier design.

DETAILED DESCRIPTION OF THE INVENTION

Figure 1:
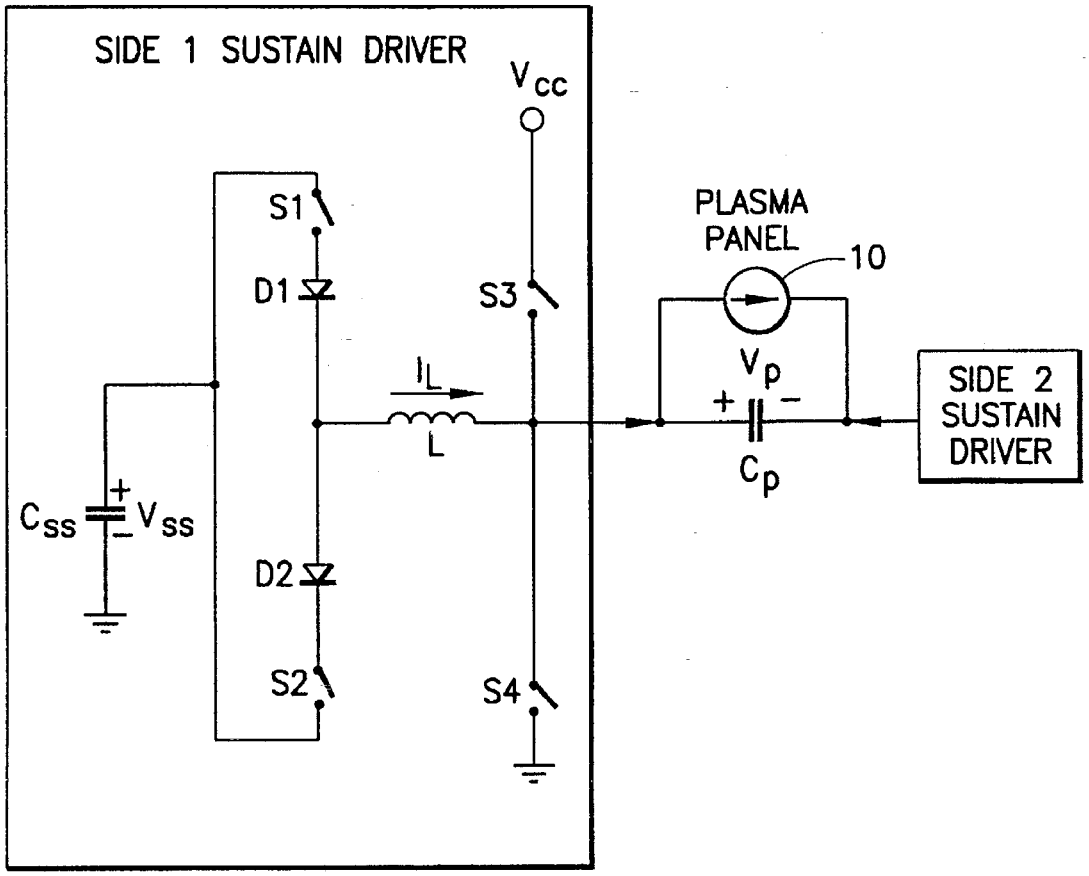
FIG. 1 PRIOR ART
FIG. 1 is an idealized circuit diagram of a prior art sustain driver for an AC plasma panel.
Figure 2:
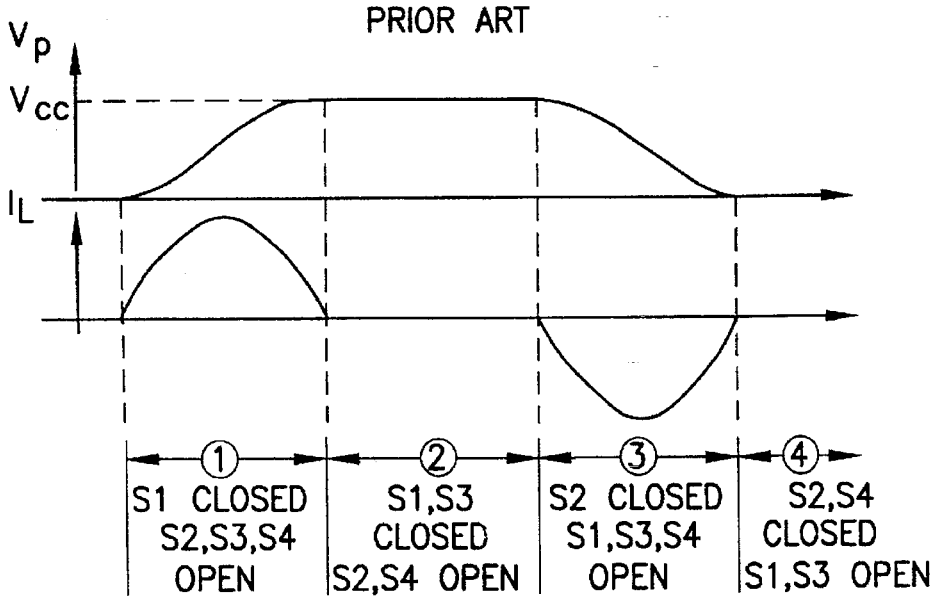
FIG. 2 PRIOR ART
FIG. 2 is a waveform diagram illustrating the operation of the circuit of FIG. 1.
Figure 3:
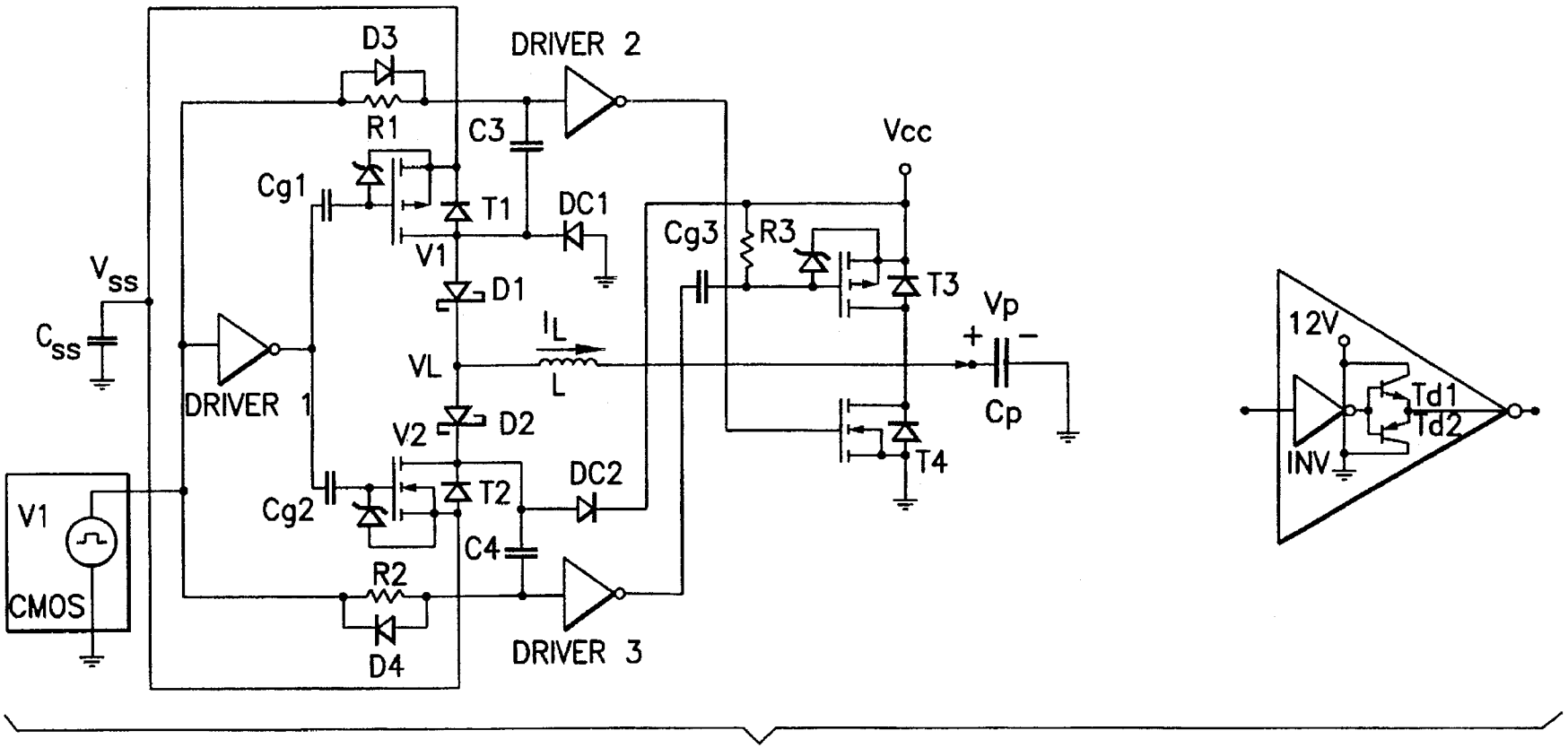
FIG.3 PRIOR ART
FIG. 3 is a detailed circuit diagram of the idealized prior art sustain driver of FIG. 1.
Figure 4:
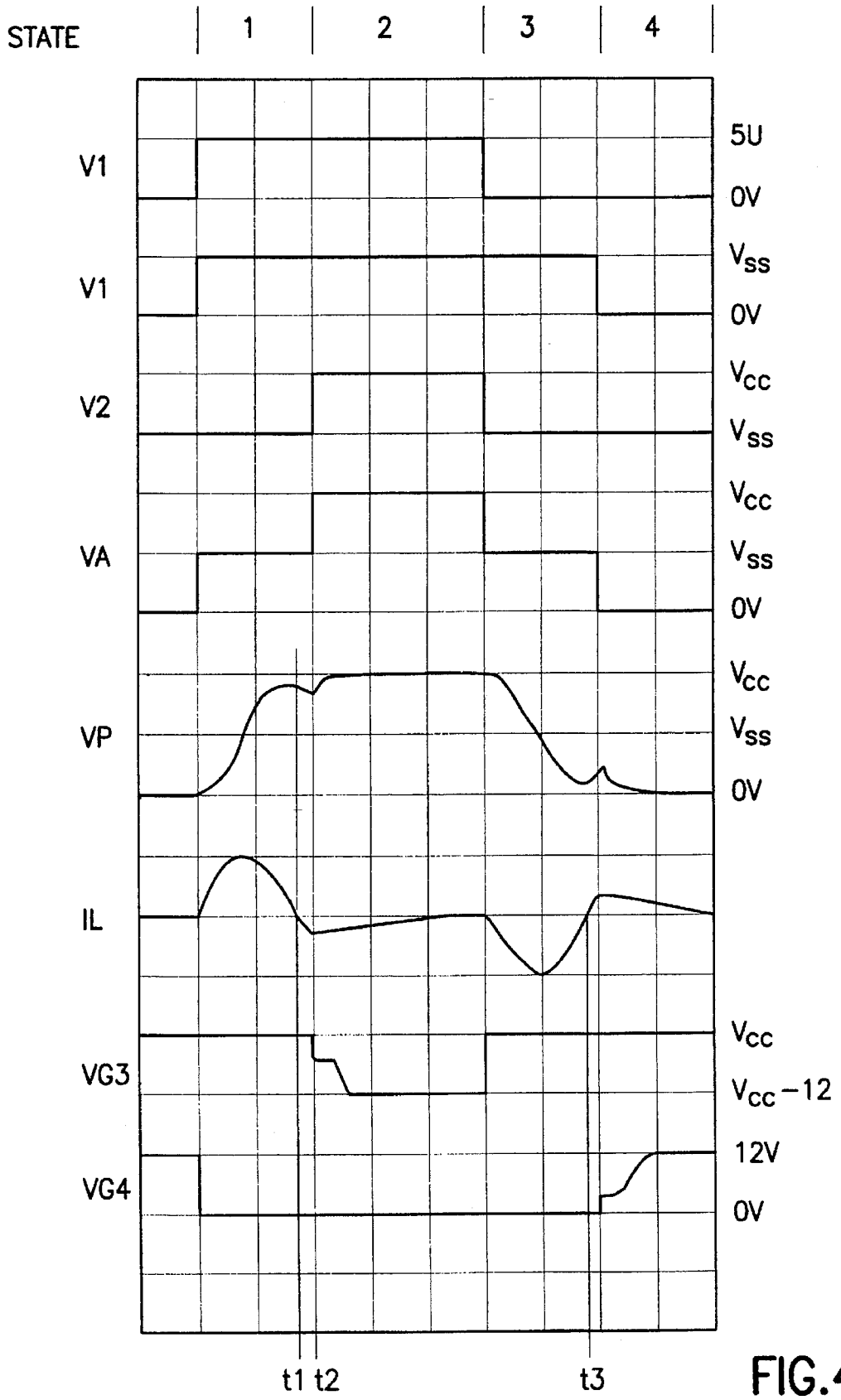
FIG.4 PRIOR ART
FIG. 4 is a waveform diagram illustrating the operation of the circuit of FIG. 3.
Figure 5:
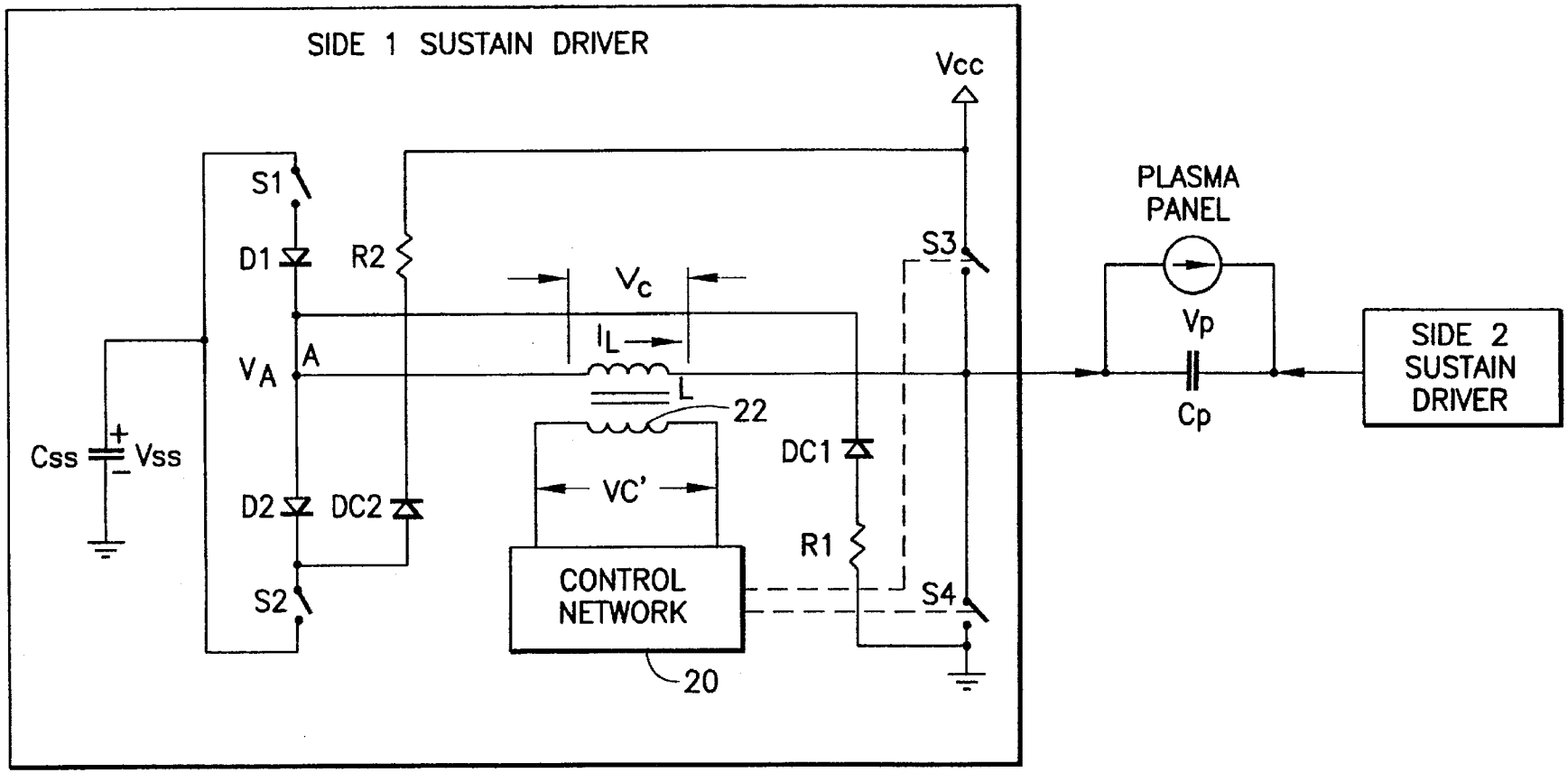
FIG. 5 is an idealized circuit diagram of a sustain driver for an AC plasma panel incorporating the invention.

FIG. 5 illustrates the changes made by the invention hereof to the prior art sustain driver of FIG. 1. A control network 20 has been added and is coupled to inductor L via a secondary winding 22. Control network 20 controls the conductivity states of switches S3 and S4 and operates in accordance with the waveforms shown in FIG. 6. Control network 20 uses the voltage across inductor L (and secondary winding 22) to slowly close the output switch S3 after the output has risen past the halfway point. On the fall, switch S4 is slowly closed after the output descends past the halfway point. Diode DC2 and resistor R2 dampen one polarity of flyback current and diode DC1 and resistor R1 dampen the opposite polarity flyback current. The conductivity states of S1 and S2 are controlled by circuitry (not shown) that is responsive to input rise and fall of the logic control signal.

Figure 6:
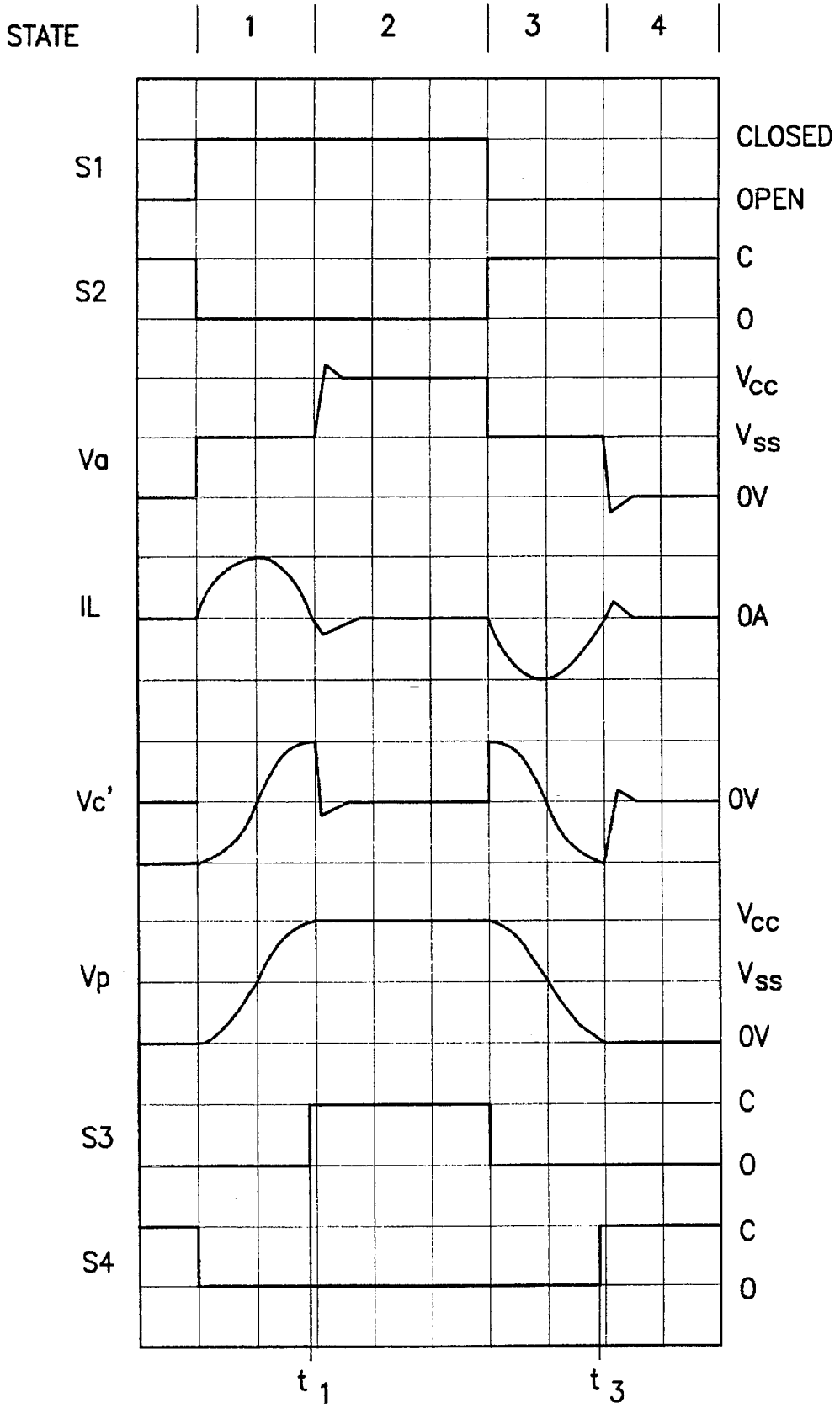
FIG. 6 is a waveform diagram illustrating the operation of the circuit of FIG. 5.

The operation of the four switching states of the circuit of FIG. 5 and timing diagrams of FIG. 6 are explained in detail below, where it is assumed that prior to State 1, the recovery voltage, Vss, is at Vcc/2 (where Vcc is the sustain power supply voltage), Vp is at zero, S1 and S3 are open, and S2 and S4 are closed.

State 1: Switches S2 and S4 are opened, and switch S1 is closed, thus applying Vss to node A. Vc is the voltage across inductor L, i.e., $Vc=Vp-V_A$. Since the current through inductor L is proportional to the time integral of the voltage across it, current $I_L$ increases for the first half of State 1 and then decreases as panel voltage Vp rises above recovery voltage Vss, during the second half of State 1. Control network 20 senses Vc' across secondary winding 22, which is proportional to Vc, and allows switch S3 to be turned on only after Vp has crossed Vss, the half-way point and then only during the rise of Vp. In the ideal case, S3 is closed at the positive peak of Vc, time t1 and the instant the inductor L current $I_L$ equals zero. Briefly stated, S3 is to be closed and ready for full conduction when $I_L$ falls to zero at the end of State 1. This action enables the following flyback current through Inductor L to be drawn from the Vcc supply, through S3, and not from the panel.

State 2: S1 and S3 remain closed, allowing S3 to be the source of both the current to sustain discharges in the panel and the flyback current which flows through inductor L. The flyback current brings voltage $V_A$ at node A up to Vcc. The energy induced into inductor L by the flyback current is dissipated by conduction through diodes D2, DC2 and resistor R2. The value of resistor R2 is chosen to dissipate the flyback energy before State 3.

State 3: S1 and S3 are opened, S4 remains open, and S2 is closed, bringing voltage $V_A$ at node A down to Vss. Vp is now greater than $V_A$, causing negative current $I_L$ to flow proportional to the time integral of the voltage Vc across the inductor. Once the falling voltage Vp crosses the half-way point, Vc reverses polarity and control network 22 turns on switch S4 at the negative peak of Vc at time t3 in a manner similar to that described above for State 1.

State 4: S4 is closed while the sustainer on the opposite side of the panel rises, discharges, and falls since S4 is part of the return path for the opposite sustainer. When the voltage flyback occurs, the flyback current is drawn from S4 rather than from the panel, and returns the voltage Vc back to zero.

Figure 7:
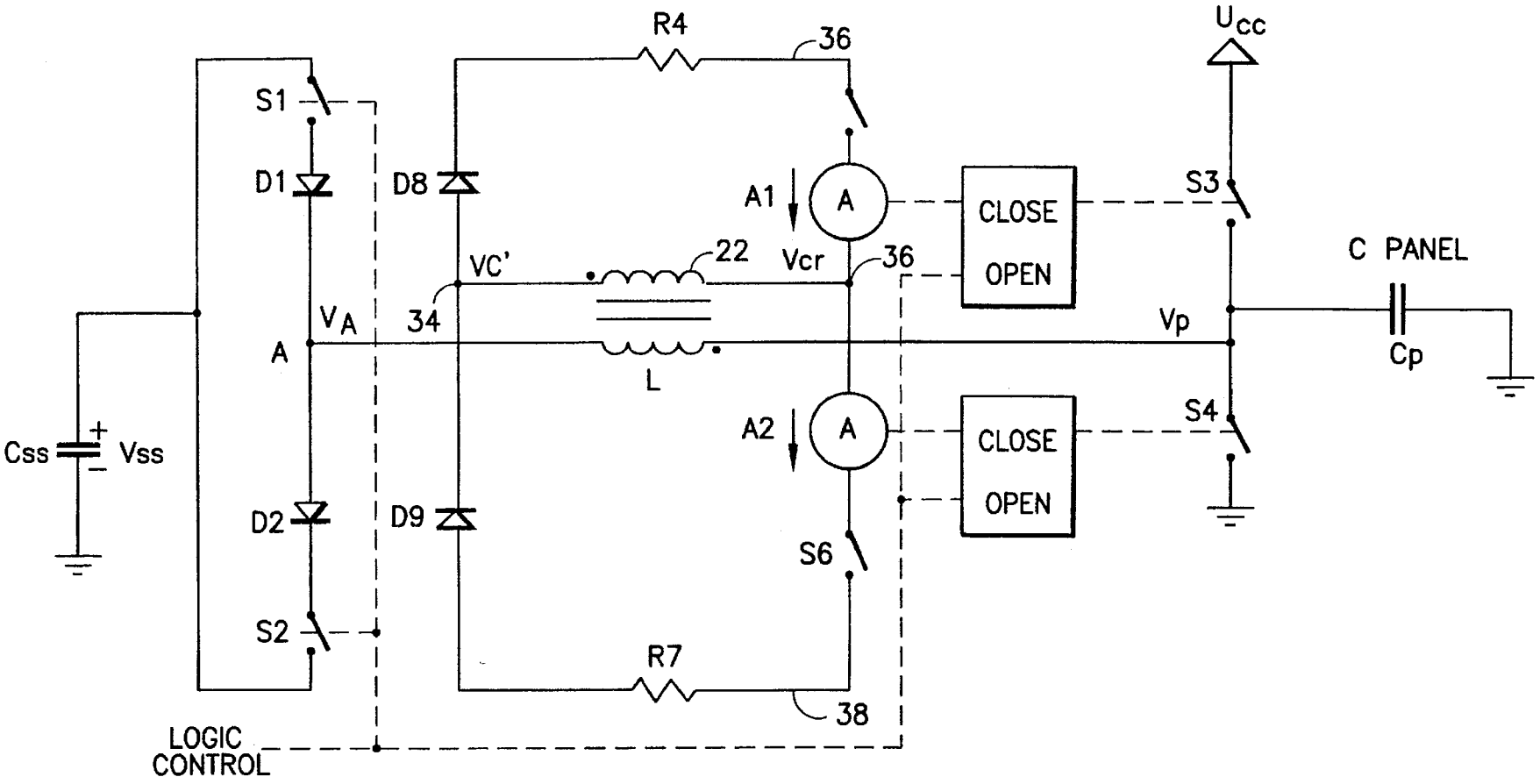
FIG. 7 is an idealized circuit diagram illustrating further details of the sustain driver of FIG. 5.
Figure 8:
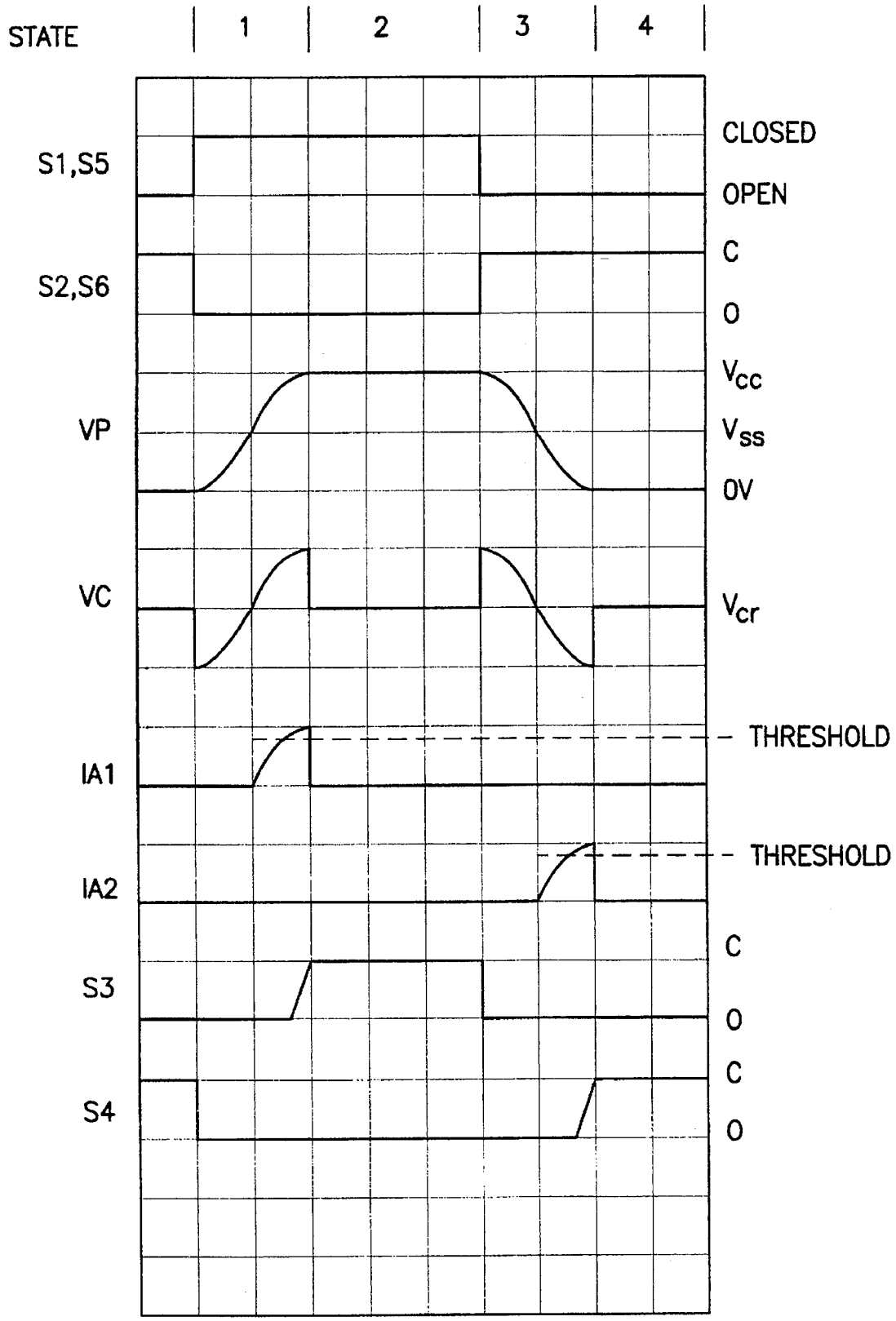
FIG. 8 is a waveform diagram illustrating the operation of the circuit of FIG. 7.

FIG. 7 shows a simplified model of control network 20 and includes a loop that includes a pair of current meters A1 and A2 positioned between a pair of switches S5 and S6. Secondary coil 22 is connected between a pair of nodes 34 and 36. Diode D8 and resistor R4 connect node 34 to switch S5 and diode D9 and resistor R7 connect switch S6 to node 34. FIG. 8 details the timing of control network 20.

Using the same switching state analysis, the operation of the control network of FIG. 7 will be considered with the aid of timing diagram of FIG. 8. Prior to State 1, secondary winding 22 has 0 V across it, S6 is closed and S5 is open. Current meter A2 measures the current through switch S6 and causes switch S4 to be closed when a threshold is crossed. S4 remains closed until the de-assertion of the logic control signal.

State 1: Switch S5 is closed and S2, S4, and S6 are opened. When S1 is closed by an input sustain pulse transition, Vss is applied to node A, and Vc' goes negative relative to Vcr. This negative voltage reverse biases DS, closing off upper current loop 36 and since S6 is open, no current flows through lower loop 38. As current flows through the primary winding of inductor L into the panel, the panel voltage Vp rises with respect to $V_A$. As a result, Vc' rises in accord with the panel voltage Vp (divided by the turns ratio of inductor L). Half-way through State 1, panel voltage Vp rises above $V_A$, causing Vc' to rise above Vcr. D8 is now forward biased. R4 controls the amount of current allowed to flow through upper loop 36. As Vc' rises with panel voltage Vp, the current through R4 rises and the threshold of current meter A1 is crossed, causing the closing of S3. The value of R4 is chosen to precisely determine the turn-on of S3 any time after the midpoint of the sustainer rise. S3 will remain closed until the de-assertion of the logic control signal in state 3.

State 2: Once the voltage flyback occurs, Vc' returns to Vcr, and the control network circuit sits idle.

State 3: S1, S3, and S5 open, S6 and S2 close, pulling $V_A$ back down to Vss. The panel voltage Vp is greater than $V_A$, making Vc' go positive again, reverse biasing D9. Since S5 is open, no current can flow through upper loop 36. As the panel voltage Vp drops, Vc' drops and crosses Vcr at the midpoint of the fall. D9 is now forward biased. As Vp continues to fall, Vc' becomes increasingly negative, increasing the current through R7, until the threshold of current meter A2 is reached. This causes closure of S4 and the transition is complete. S4 will remain closed until the next assertion of the logic control signal.

State 4: Again the return voltage flyback brings $V_A$ back to zero and Vc' returns to Vcr.

Figure 9:
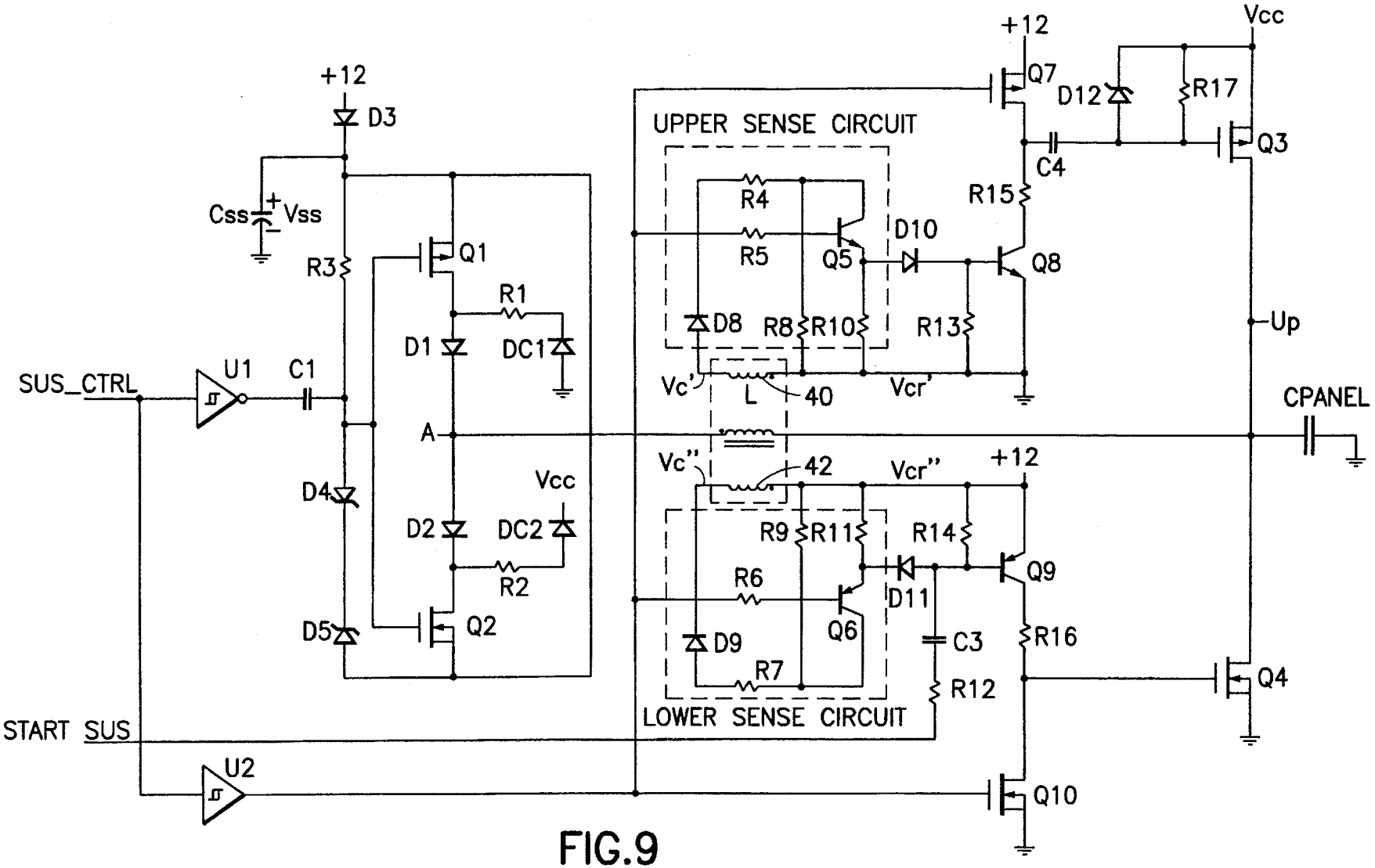
FIG. 9 is a detailed circuit diagram of a sustain driver incorporating the invention.
Figure 10:
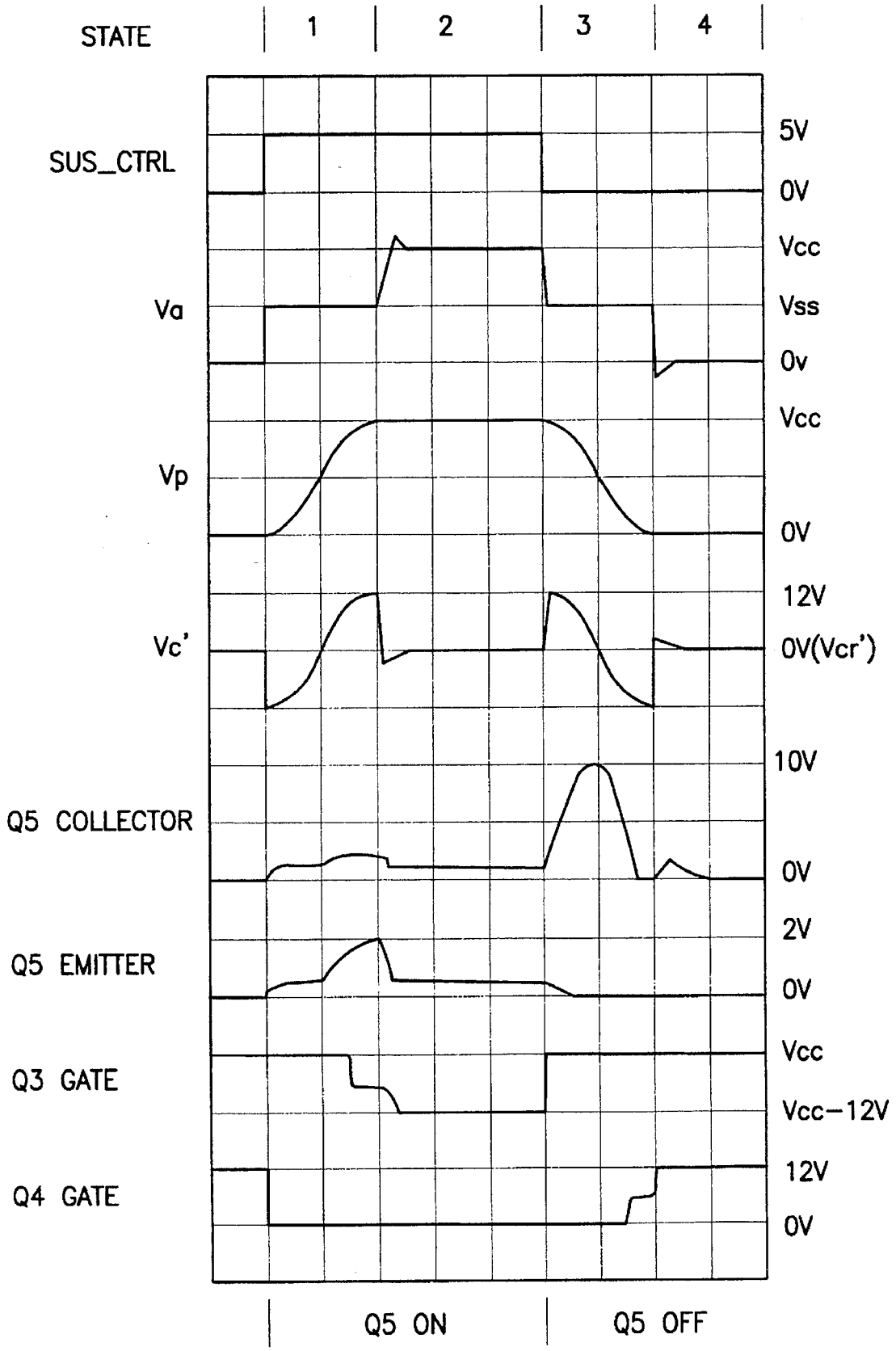
FIG. 10 is a waveform diagram illustrating the operation of the circuit of FIG. 9.

A preferred circuit implementation of the invention is shown in FIG. 9 and its waveforms are illustrated in FIG. 10. The implementation of FIG. 9 uses two control windings 40 and 42 added to inductor L, rather than the one secondary winding approach described for FIGS. 5 and 7, above. Since Q3 is a P-channel mosfet, its gate needs to be pulled low to turn it on, so NPN transistors Q5 and Q8 are used, with Vcr' connected to ground. Q4 is an N-channel mosfet, thereby requiring positive gate drive, so a PNP implementation is used, for Q6 and Q9 with Vcr" connected to +12 V. Both windings 40 and 42 have the same number of turns and polarity. Vc" simply has a 12 V level shift.

Operation of the circuit of FIG. 9 begins with SUS_CTRL de-asserted, Q2, Q6, Q7, and Q4 on. STARTSUS is a startup signal used to turn Q9 on which then turns Q4 on, in turn. For the sustain circuit of FIG. 9 to start up correctly, Q4 must be on prior to SUS_CTRL being asserted. It is common practice to pulse STARTSUS periodically at a time when Vp is low.

State 1 begins with the activation of SUS_CTRL. Buffer U1 drives the common gate of recovery mosfets Q1 and Q2, turning Q2 off and Q1 on. Buffer U2 produces a 12 V drive signal from SUS_CTRL to turn Q10 and Q5 on, and Q6 and Q7 off.

Once again, Q1 turning on applies Vss to node A. The polarities of secondary windings produce negative voltages Vc' and Vc" relative to their respective references, reverse biasing D8 and forward biasing D9. Q6 is off, so the low side driver Q9 is not turned on. The amplitude at each secondary winding is equal to Vss divided by the turns ratio; typically selected for 12 V peak.

As current through inductor L builds to its peak, the voltage across inductor L diminishes to zero when the panel's voltage Vp equals recovery voltage Vss. Since the secondary windings accurately reflect the voltage across inductor L, Vc' returns to zero and Vc" returns to +12 volts.

At the zero crossing of Vc', inductor L reaches its peak energy level, and continues to source current until its energy is depleted. As the panel continues to charge, secondary windings 40 and 42 become increasingly positive, reverse biasing D9 and forward biasing D8. As voltage Vc' increases, so does the current through transistor Q5. The voltage at Q5's emitter quickly rises high enough to forward bias D10 and turn on Q8, the high side driver. Q8 saturates, providing ample drive to turn on the high side FET Q3. Damping resistor R15 prevents Q3 from turning on too quickly.

As the sustainer circuit's output continues to rise, the drain-to-gate capacitance of FET Q3 sources additional current for R15 to sink, keeping Q3 in the linear region. While FET Q3 is in the linear region, it only sources a small percentage of the energy needed to complete the sustainer's rise and therefore does not dissipate excessive power.

Turn-on of the high side driver can be set very precisely by adjusting the value of R4 in the collector circuit of Q5. Q8 will turn on when the voltage across R10 exceeds two diode drops. Varying R4 changes the secondary winding voltage required to raise the voltage at R10 sufficiently to turn on the driver.

At the start of State 2, high side FET Q3 is fully on and any residual energy in inductor L is returned to Vcc through Q3. When the energy of inductor L reaches zero, current $I_L$ has stopped flowing. However, panel voltage Vp now exceeds the recovery voltage Vss and negative current $I_L$ flows back towards recovery FETs Q1 and Q2, causing $V_A$ to rise sharply to the sustain voltage. This voltage flyback charges the capacitance of T2 which requires current to flow through L. This puts undesirable energy into inductor L, however these currents flow directly from Vcc through Q3 and not from the panel. The addition of R5 dissipates this energy quickly so that the only currents flowing in the system are the sustainer discharge currents.

After all the flyback currents have subsided, there is zero voltage across inductor L. Hence the secondary winding voltage Vc' also returns to zero and Q8 shuts off. Q3 remains on by means of charge on the gate of Q3 until Q7 turns on or Q3 is eventually turned off by the resistor-capacitor combination R17 and C4.

State 3 begins the fall of the sustainer output, with the fall of SUS_CTRL. Q7 turns on, shutting off the high side FET Q3. Q10 shuts off to allow Q4 to be turned on by Q9 when driven by the lower sense circuit. Q5 shuts off to disable the upper sense circuit and Q6 turns on to enable the lower sense circuit. Buffer U1 drives Q1 off and Q2 on, pulling $V_A$ back down to the recovery voltage Vss. Lower secondary winding 42 behaves identically to the upper secondary winding 40, however its connection to 12 volts centers its waveform about +12 V to drive PNP transistors Q6 and Q9.

The drop of voltage $V_A$ applies voltage ($V_A$–Vp) across inductor L, which reverse biases D9. Negative current $I_L$ through inductor L builds as the output falls.

When the output voltage crosses the recovery voltage Vss, Vc" will drop below +12 V and forward biases D9. Again the secondary voltage is across R7, establishing the current through R11. When the voltage across R11 exceeds two diode drops, Q9 turns on and begins to turn on Q4 through damping resistor R16. Again this turn-on is slow, allowing inductor L to remove most of the charge from the panel's capacitance therefore not dissipating excessive power.

State 4 occurs when the low side FET Q4 is fully on and any residual inductor current is drawn from ground to complete the sustainer's fall. Another voltage flyback occurs, this time returning $V_A$ to ground, and the flyback energy is dissipated in R2.

It should be noted that resistors R8 and R9, are used to bleed off any charge on the collectors of Q5 and Q6. The charge develops when the diodes D8 and D9 are forward biased while the transistors are off. If this charge is not removed prior to turning on Q5 or Q6, a false signal can be sent to Q8 or Q9.

The exclusive use of induced voltages in the secondary windings to control the turn on of output drivers Q3 and Q4 has a number of advantages over flyback designs. First and foremost is the ability to precisely control the high side driver's turn-on. Operating margin studies have shown that the sustain voltage operating window can be widened over designs having the flyback based circuits. Sustainers have been successfully built and operated for high frequency addressing circuits as well as high voltage sustainer circuits.

A common fear with "early" turn on circuits is the danger of turning on both output transistors at the same time during a failure condition. Since the output drivers cannot be turned on before the output voltage exceeds the recovery voltage, under most fault conditions, the sustainer will lay idle, unable to start up.

Efficiency can be greatly reduced if the output driver is allowed to begin to turn on before the inductor current peaks. Since the secondary winding switches polarity at the same time the inductor's current peaks, it is difficult for the output driver to impede the inductor's operation. Even with minimal signal delays of 50 to 100 nS, the output is typically up to 75% of its final level when the output driver turns on.

In variable capacitance applications, states 1, and 3 will expand in time with the increasing capacitance. Since the sense circuit activates the output driver based on the inductor voltage, the output will turn on at the same voltage regardless of the rise time. In varying voltage applications, the circuit should be tuned for optimum turn-on at the minimum operating voltage. As the voltage is increased, the turn-on will occur earlier in the rise, as the sense winding voltage is proportional to the sustain voltage. This is an added benefit, since gas discharges become faster and stronger as the voltage is increased.

Radiated noise has been diminished considerably by removing the flyback currents from the panel and system grounds.

It should be understood that the foregoing description is only illustrative of the invention. Various alternatives and modifications can be devised by those skilled in the art without departing from the invention. For instance, this invention is applicable to DC plasma panels, electroluminescent displays, LCD displays, or any application driving capacitive loads. Accordingly, the present invention is intended to embrace all such alternatives, modifications and variances which fall within the scope of the appended claims.

I claim:

1. An energy efficient driver circuit for driving a display panel having panel electrodes and panel capacitance, said driver circuit comprising:

inductor means having a first terminal and a second terminal, said second terminal coupled to said panel electrodes;

driving voltage source means for providing a driving voltage;

voltage supply means for providing a supply voltage of a magnitude which is greater than said driving voltage;

first switch means for selectively coupling said driving voltage source means to said first terminal in response to an input signal transition, said input signal transition commencing a first state wherein, during said coupling, a first current flow occurs through said inductor means to charge said panel capacitance, said inductor means causing said panel electrodes to achieve a voltage in excess of said driving voltage, at which point said first current flow reaches zero;

second switch means for selectively coupling said voltage supply means to said second terminal and said panel electrodes; and switch control means coupled to said inductor means and responsive to current flow therein, said switch control means operative during at least a portion of said first state to maintain said second switch means in an open condition, and thereafter in response to a signal derived from said inductor means, to cause a closure of said second switch means at a time which enables said second switch means to be fully conductive at about the time said first current flow reaches zero, whereby said voltage supply means, during a succeeding second state, supplies current to both said panel electrodes and flyback current to said inductor means.

2. The energy efficient driver circuit as recited in claim 1, further comprising:

third switch means for selectively coupling said driving voltage source means to said first terminal in response to a reverse input signal transition, said reverse input signal transition commencing a third state wherein, during said coupling, a second current flow occurs through said inductor to discharge said panel capacitance, said inductor causing said panel electrodes to reach a voltage below said driving voltage, at which point said second current flow reaches zero;

fourth switch means for selectively coupling said second terminal and said panel electrodes to a source of common potential;

said switch control means operative during said third state to initially maintain said fourth switch means in an open condition, and thereafter in response to signals derived from said inductor means, to cause a closure of said fourth switch means at a time which enables said fourth switch means to be fully conductive when said second current flow reaches zero, whereby said source of common potential forms a sink for flyback current from said inductor means and provides a discharge path for said panel capacitance.

3. The energy efficient driver circuit as recited in claim 1, wherein said driving voltage is about one half of said supply voltage.

4. The energy efficient driver circuit as recited in claim 1, wherein said switch control means is inductively coupled to said inductor means.

5. The energy efficient driver circuit as recited in claim 1, wherein said switch control means includes an upper sense circuit which, during said first state, causes closure of said second switch means only after said panel electrodes manifest a voltage that exceeds said driving voltage and before said first current reaches zero.

6. The energy efficient driver circuit as recited in claim 1, further comprising:

a flyback return circuit including resistive dissipation means coupled between said first terminal of said inductor means and said voltage supply means for providing a dissipation pathway for said flyback current.

7. The energy efficient driver circuit as recited in claim 2, wherein said driving voltage is about one half of said supply voltage.

8. The energy efficient driver circuit as recited in claim 2, wherein said switch control means is inductively coupled to said inductor means.

9. The energy efficient driver circuit as recited in claim 2, wherein said switch control means includes a lower sense circuit which, during said third state, causes closure of said fourth switch means only after said panel electrodes manifest a voltage that is less than said driving voltage and before said second current reaches zero.

10. The energy efficient driver circuit as recited in claim 2, further comprising:

a flyback return circuit including resistive dissipation means coupled between said first terminal of said inductor means and said source of common voltage for providing a dissipation pathway for said flyback current.

* * * * *